US012799401B2

(12) United States Patent
Stummann et al.

(10) Patent No.: US 12,799,401 B2
(45) Date of Patent: Nov. 17, 2026

(54) PROCESS FOR HYDROTREATMENT OF AROMATIC NITROGEN COMPOUNDS

(71) Applicant: Topsoe A/S, Kgs. Lyngby (DK)

(72) Inventors: Magnus Zingler Stummann, Copenhagen OE (DK); Jens Anders Hansen, Holte (DK); Marcus Symreng, Dalby (SE); Sylvain Verdier, Copenhagen (DK)

(73) Assignee: TOPSOE A/S, Kgs. Lyngby (DK)

( * ) Notice: Subject to any disclaimer, the term of this patent is extended or adjusted under 35 U.S.C. 154(b) by 190 days.

(21) Appl. No.: 18/699,166

(22) PCT Filed: Oct. 26, 2022

(86) PCT No.: PCT/EP2022/079932
§ 371 (c)(1),
(2) Date: Apr. 5, 2024

(87) PCT Pub. No.: WO2023/073018
PCT Pub. Date: May 4, 2023

(65) Prior Publication Data

US 2024/0400904 A1 Dec. 5, 2024

(30) Foreign Application Priority Data

Oct. 26, 2021 (EP) ..... 21204787

(51) Int. Cl.
*C10G 65/12* (2006.01)
*C10G 1/00* (2006.01)
*C10G 3/00* (2006.01)

(52) U.S. Cl.
CPC ..... *C10G 1/002* (2013.01); *C10G 3/50* (2013.01); *C10G 65/12* (2013.01);
(Continued)

(58) Field of Classification Search
CPC ..... C10G 1/002; C10G 3/50; C10G 65/12; C10G 2300/1003; C10G 2300/1011;
(Continued)

(56) References Cited

U.S. PATENT DOCUMENTS 4,424,115 A 1/1984 Farrell
2009/0151233 A1* 6/2009 Miller ..... C10G 1/10 44/307

(Continued)

FOREIGN PATENT DOCUMENTS

EP 2658954 B1 3/2018
EP 3019577 B1 4/2018

(Continued)

OTHER PUBLICATIONS

International Search Report mailed on Dec. 15, 2022, by the European Patent Office for International Application No. PCT/EP2022/079932, 5 Pages.

(Continued)

*Primary Examiner* — Ellen M Mcavoy
*Assistant Examiner* — Chantel Graham
(74) *Attorney, Agent, or Firm* — Boone IP Law

(57) ABSTRACT

A process for conversion of a feedstock originating from thermal decomposition of solids, containing from at least 0.5 wt % nitrogen and less than 15 wt % nitrogen, including the steps of directing the feedstock to contact a material catalytically active in hydrotreatment under active hydrotreatment conditions in the presence of dihydrogen, to provide a hydrotreated intermediate, adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds, directing at least an amount of the (Continued)

hydrotreated intermediate to contact a material catalytically active in hydrodearomatization under the active hydrodearomatization conditions, in the presence of dihydrogen, to provide a further converted intermediate. This has the associated benefit of providing a pyrolysis plant with the ability to remove aromatic nitrogen efficiently from the pyrolysis oil.

20 Claims, 3 Drawing Sheets

(52) U.S. Cl.
CPC ..... *C10G 2300/1003* (2013.01); *C10G 2300/1011* (2013.01); *C10G 2300/202* (2013.01); *C10G 2300/4006* (2013.01); *C10G 2300/4012* (2013.01); *C10G 2300/4018* (2013.01)

(58) Field of Classification Search
CPC ..... C10G 2300/202; C10G 2300/4006; C10G 2300/4012; C10G 2300/4018; C10G 67/04; C10G 3/42; C10G 45/44; C10G 47/00; C10G 69/06
See application file for complete search history.

(56) References Cited

U.S. PATENT DOCUMENTS

| | | | | |
|---|---|---|---|---|
| 2011/0119994 | A1* | 5/2011 | Hogendoorn | C10G 3/46 44/307 |
| 2011/0167713 | A1 | 7/2011 | Quignard | |
| 2012/0261307 | A1 | 10/2012 | Joseck | |
| 2017/0009143 | A1 | 1/2017 | Urade | |
| 2021/0062098 | A1 | 3/2021 | Iversen | |

FOREIGN PATENT DOCUMENTS

| | | | | |
|---|---|---|---|---|
| RU | 2283857 | C2 | 6/2005 | |
| RU | 2283339 | C2 | 9/2006 | |
| RU | 2291184 | C2 | 1/2007 | |
| RU | 2707965 | C1 | 12/2019 | |
| WO | 03004583 | A1 | 1/2003 | |
| WO | 03004586 | A1 | 1/2003 | |
| WO | 03004587 | A1 | 1/2003 | |
| WO | 2015004329 | A1 | 1/2015 | |
| WO | 2015101713 | A1 | 7/2015 | |
| WO | 2018142343 | A1 | 8/2018 | |
| WO | WO-2020083989 | A1 * | 4/2020 | C10G 47/14 |
| WO | WO-2020239729 | A1 * | 12/2020 | C10G 19/02 |

OTHER PUBLICATIONS

European Search Report mailed on Apr. 13, 2022 by the European Patent Office for European Application No. EP21204787.2, 10 Pages.
Written Opinion mailed on Dec. 15, 2022, by the European Patent Office for International Application No. PCT/EP2022/079932, 9 Pages.
U.S. Appl. No. 18/704,131, Magnus Zingler Stummann, filed Apr. 24, 2024.
Russian Office Action Substantive Examination for Application No. 2024114237/04 dated Mar. 26, 2026 with English translation, 14 pages.
Russian Office Action (with English translation) issued by the Federal Service for Intellectual Property (FIPS) on Apr. 8, 2026 in Russian Application No. 2024114194/04, 20 pages.
Satterfield, C.N., Cocchetto, J.F. Pyridine hydrodenitrogenation: An equilibrium limitation on the formation of piperidine intermediate. // AIChE J. 1975, vol. 21 (6), pp. 1107-1111, 6 pages.
Senicheva L.V. (with English translation) Physical Chemistry: Chemical Equilibrium : Study Guide / L. V. Senicheva, V. A. Yargaeva.—Khabarovsk : Pacific National University Press, 2008, Section 1.7, 8 pages.

* cited by examiner

PROCESS FOR HYDROTREATMENT OF AROMATIC NITROGEN COMPOUNDS

The present invention relates to a process for efficient removal of nitrogen from hydrocarbons derived from aromatic feedstocks such as pyrolysis oil.

Liquid products of thermal decomposition (for convenience pyrolysis oil), such as pyrolysis or hydrothermal liquefaction (HTL), of certain raw materials, such as lignocellulosic biomass or certain types of plastics (such as polyamides, polyurethanes) commonly have a high nitrogen content, and the denitrogenation of such products has proven difficult, with only moderate levels of denitrogenation being possible in spite of processes employing severe conditions.

We have now identified a process with a potential for obtaining such desired high denitrogenation, which involves a combination of initial denitrogenation with subsequent dearomatization, based on an analysis indicating that the majority of refractive nitrogen compounds are likely to be aromatic.

The proposed process involves initial hydrotreatment at high temperatures, followed by a second hydrotreatment at conditions shifting thermodynamic equilibrium from aromatic nitrogen-containing compounds to non-aromatic nitrogen-free compounds, such as lower temperatures or after removal of ammonia by washing with water, benefiting from the fact that the thermodynamic equilibrium favors non-aromatic structures at moderate temperatures and that removal of ammonia product favors the reaction forming ammonia.

As used herein, the term "thermal decomposition" shall for convenience be used broadly for any decomposition process, in which a material is partially decomposed at elevated temperature (typically 250° C. to 800° C. or even 1000° C.), in the presence of substoichiometric amount of oxygen (including no oxygen). The product will typically be a combined liquid and gaseous stream, as well as an amount of solid char. The term shall be construed to include processes known as pyrolysis and hydrothermal liquefaction, both in the presence and absence of a catalyst.

For simplicity all products from thermal decomposition, such as pyrolysis and thermal liquefaction, will in the following be referred to as pyrolysis oil, irrespective of the nature of the originating process.

In the following the abbreviation $ppm_v$ shall be used to signify volumetric parts per million, e.g. molar gas concentration.

In the following the abbreviation $ppm_w$ shall be used to signify weight parts per million, e.g. the mass of sulfur atoms relative to the mass of a liquid hydrocarbon stream.

In the following the abbreviation wt % shall be used to signify weight percentage.

In the following the abbreviation vol % shall be used to signify volume percentage for a gas.

Where concentrations in the gas phase are given, they are, unless otherwise specified given as molar concentration.

Where concentrations in liquid or solid phase are given, they are, unless otherwise specified given as weight concentration.

The term aromatic molecule shall for the purpose of the present application be used to signify homocyclics, comprising only carbon atoms in the aromatic ring, as well as heterocyclics, comprising other atoms than carbon, such as oxygen and nitrogen. The term shall also cover both monocyclics and polycyclics, including fused aromatics.

The aromatic content of a liquid is in accordance with the art the total mass of molecules having at least one aromatic structure, relative to the total mass of all molecules in %.

A first aspect of the present disclosure relates to a process for conversion of a feedstock originating from thermal decomposition of solids, containing from at least 0.5 wt % nitrogen, at least 2 wt % nitrogen or at least 5 wt % nitrogen and less than 10 wt % or less than 15 wt % nitrogen, comprising the steps of a. directing the feedstock to contact a material catalytically active in hydrotreatment under active hydrotreatment conditions in the presence of dihydrogen, to provide a hydrotreated intermediate,
b. adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds,
c. directing at least an amount of the hydrotreated intermediate to contact a material catalytically active in hydrodearomatization under said active hydrodearomatization conditions, in the presence of dihydrogen, to provide a further converted intermediate.

This has the associated benefit of providing a process with the ability to remove aromatic nitrogen efficiently from the pyrolysis oil. The extent of hydrotreatment may be above 10%, 20% or 50%, and up to substantially complete, 90% or 70%. The extent of hydrodearomatization may be above 10%, 15% or 20%, and up to substantially complete, 70% or 50%. In addition to the high amount of nitrogen, feedstock originating from thermal decomposition of solids—especially solids originating from waste or biological materials—will typically comprise at least 0.5 wt %, 5 wt % or 10 wt % and up to 20 wt %, 40 wt % or even more organically bound oxygen.

A second aspect of the present disclosure relates to a process according to the first aspect, in which the adjusting of one or more conditions involves reducing the temperature of the hydrotreated intermediate by at least 25° C., 50° C. or 75° C.

This has the associated benefit of providing a process or a pyrolysis plant with the ability to remove aromatic nitrogen efficiently from the pyrolysis oil cost effectively by a cooling step.

A third aspect of the present disclosure relates to a process according to any aspect above, in which the adjusting of one or more conditions involves withdrawing an amount of ammonia from the hydrotreated intermediate e.g. by addition of wash water and a flash separation.

This has the associated benefit of providing a process or pyrolysis plant with the ability to remove aromatic nitrogen efficiently from the pyrolysis oil, by removal of ammonia, which will highly shift the equilibrium.

A fourth aspect of the present disclosure relates to a process according to any aspect above, in which the adjusting of one or more conditions involves increasing the pressure by at least 5 MPa, 10 MPa or 50 MPa and less than 70 MPa or 100 MPa.

This has the associated benefit of providing a pyrolysis plant with the ability to remove aromatic nitrogen efficiently from the pyrolysis oil, by employing the effect of pressure on the equilibrium, which may be especially beneficial if an existing unit designed for high pressure operation is revamped.

A further aspect of the present disclosure relates to a process for conversion of a feedstock originating from thermal decomposition of solids, containing from at least 0.5 wt % nitrogen, at least 2 wt % nitrogen or at least 5 wt % nitrogen and less than 10 wt % or less than 15 wt % nitrogen, comprising the steps of a. directing the feedstock to contact a material catalytically active in hydrotreatment under hydrotreatment conditions in the presence of dihydrogen, to provide a hydrotreated intermediate, c. directing at least an amount of the hydrotreated intermediate to contact a material catalytically active in hydrodearomatization under hydrodearomatization conditions involving an average temperature below the maximum temperature of step (a), such as from 50° C. to 100° C. or 150° C. below, in the presence of dihydrogen, to provide a further converted intermediate.

This has the associated benefit of shifting the equilibrium between aromatic nitrogen compounds and non-aromatic compounds towards non-aromatic compounds at reduced temperature, such that a high extent of nitrogen removal may be observed.

A fifth aspect of the present disclosure relates to a process according to any aspect above, in which the feedstock originates from a thermal decomposition process, in which a material is partially decomposed at elevated temperature, such as above 250° C., above 400° C., above 600° C. and below 800° C. or below 1000° C., in the presence of substoichiometric amount of oxygen including absence of oxygen.

This has the associated environmental and economic benefit of such feedstock being obtained from a wide range of solid waste or by-products.

A sixth aspect of the present disclosure relates to a process according to any aspect above wherein said material catalytically active in hydrodearomatization comprises an active metal taken from the group comprising platinum, palladium, nickel, cobalt, tungsten and molybdenum, preferably one or more elemental noble metals such as platinum or palladium and a refractory support, preferably amorphous silica-alumina, alumina, silica, titania or molecular sieves, or combinations thereof.

This has the associated benefit of such catalytically active materials being stable and active in hydrodearomatization, and of effectively enabling hydrodearomatization at moderate temperatures. The effect is preferably obtained by the material catalytically active in hydrodearomatization comprising an elevated amount of active metals, such as from at least 0.1 wt %, at least 0.5 wt % or at least 1 wt %, to 3 wt % Pt or Pd noble metal or from at least 1 wt %, at least 5 wt % or at least 15 wt % to at most 20 wt %, at most 30 wt % or at most 50 wt % molybdenum or tungsten, promoted by an amount of nickel in the range from 0.1:1 Ni:Mo+W to 2:1 Ni:Mo+W (where the ratios designate molar ratios between the amount of Ni and the total amount of Mo and W) on a refractory oxidic support such as alumina, silica, titania or molecular sieves. The hydrodearomatization catalyst may also comprise only Ni in reduced form as active metal on a refractory support or may be an unsupported bulk catalyst comprising at least 50% sulfided Mo and/or W.

A seventh aspect of the present disclosure relates to a process according to any aspect above wherein said hydrodearomatization conditions involve a temperature in the interval 200-350° C., a pressure in the interval 3-15 MPa, and a liquid hourly space velocity (LHSV) in the interval 0.5-8.

This has the associated benefit of such process conditions being suitable for hydrogenation of aromatics, with a minimum of yield loss. Preferably the pressure is above the pressure of said hydrotreatment conditions.

An eighth aspect of the present disclosure relates to a process according to any aspect above, further comprising directing an unstabilized feedstock originating from thermal decomposition of solids, to contact a material catalytically active in hydrotreatment under pretreatment conditions in the presence of dihydrogen, to provide said composition originating from thermal decomposition of solids.

This has the associated benefit of converting only the most reactive components of the unstabilized feedstock, such that the composition originating from thermal decomposition of solids is stable, and such that the risk of undesired side reactions, including polymerization and excessive heat development is minimized. Pretreatment conditions may involve a temperature in the range from at least 100° C., 120° C. or 150° C. and maximum 250° C. or 200° C.

An ninth aspect of the present disclosure relates to a process according to any aspect above, further comprising the step of separating the hydrotreated intermediate in at least one fraction not directed to step (b) and a high boiling hydrotreated intermediate, comprising at least 90 wt % material boiling above 150° C., 180° C. or 200° C., which together with an amount of dihydrogen is directed to step (b).

This has the associated benefit of the higher boiling hydrotreated intermediate directed to step (b) being rich in nitrogen containing aromatic compounds while e.g. mono-aromatic naphtha compounds are not directed to step (b) which would reduce the octane number of a naphtha fraction by removal of aromatics. Especially in such a process, the pressure of step (b) may preferably be above, such as 2 MPa or 5 MPa above, that of step (a).

A tenth aspect of the present disclosure relates to a process according to any aspect above, further comprising a step d. directing at least an amount of the further converted intermediate to contact a material catalytically active in hydrocracking under hydrocracking conditions in the presence of dihydrogen, to provide a hydrocracked intermediate.

This has the associated benefit of adjusting the product further, e.g. by adjusting boiling point or by ring opening. Especially if a naphtha fraction has been withdrawn, the reactor volume and yield loss associated with hydrocracking is reduced. Beneficially, hydrocracking is carried out after a separation of ammonia, possibly by washing with water, since the presence of elevated amounts of alkaline ammonia may deactivate the hydrocracking process, taking place on acid sites of the catalyst. Active hydrocracking may involve an extent of hydrocracking of further converted intermediate boiling above 370° C. to hydrocracked intermediate boiling below 370° C. of at least 10%, 20% or 50% and of less than 90% or 70% per pass.

An eleventh aspect of the present disclosure relates to a process according to any aspect above, further comprising the step of separating at least a high boiling further hydrotreated fraction comprising at least 90 wt % material boiling above 250° C., 300° C. or 350° C., wherein this high boiling further hydrotreated fraction and an amount of dihydrogen is directed to step (c).

This has the associated benefit of reducing the volume of the stream directed to hydrocracking, reducing the reactor volume and yield loss associated with hydrocracking.

A twelfth aspect of the present disclosure relates to a process according to any aspect above, further comprising the step of separating at least a high boiling further hydrotreated fraction comprising at least 90 wt % material boiling above 450° C., wherein this high boiling further hydrotreated fraction and an amount of dihydrogen is not directed to said step (d).

This has the associated benefit of minimizing the risk of forming heavy polynuclear aromatics from polynuclear aromatics boiling above adjusting the product further, e.g. by adjusting boiling point or by ring opening. Especially if a naphtha fraction has been withdrawn, the reactor volume and yield loss associated with hydrocracking is reduced.

A thirteenth aspect of the present disclosure relates to a process for conversion of a hydrocarbonaceous feedstock containing from at least 0.5 wt % nitrogen to less than 15 wt % nitrogen and containing at least 0.5 wt % aromatically bound nitrogen, comprising the steps of i. directing the feedstock in combination with an amount of di-hydrogen to contact a first catalytically active material comprising at least one of molybdenum and tungsten, optional in combination with nickel or cobalt on a refractory support comprising silica, titania or alumina at a temperature temperature in the interval 250-400° C., a pressure in the interval 3-15 MPa, a gas to oil ratio of 200-2000 $Nm^3/m^3$ and a liquid hourly space velocity (LHSV) in the interval 0.1-2, to produce a product stream comprising a hydrocarbonaceous liquid with a reduced content of nitrogen and an amount of ammonia, ii. adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds, such as by withdrawing an amount of ammonia, reducing iii. directing at least an amount of the hydrotreated intermediate to contact a second catalytically active material after active adjustment of at least one process condition relative to step (i) such that the equilibrium between aromatic nitrogen compounds and non-aromatic nitrogen-free compounds shifted towards non-aromatic nitrogen-free compounds.

This has the benefit of removal a bulk amount of nitrogen hetero-atoms by hydrotreatment and removing a further amount by the different mechanism of shifting the aromatic equilibrium, with the combination of the two mechanism resulting in a highly efficient removal of organically bound nitrogen. If the amount of aromatically bound nitrogen is more 0.5 wt % then the equilibrium between aromatically nitrogen compounds and non-aromatic nitrogen free compounds will limit the removal of organically bound nitrogen, and therefore shifting this equilibrium will enable a significant reduction of nitrogen content.

An thirteenth aspect of the present disclosure relates to a pyrolysis oil conversion plant, comprising a first reactor containing a material catalytically active in hydrotreatment, and a second reactor containing a material catalytically active in hydrodearomatization, wherein said second reactor is configured for receiving the outlet from the first reactor, and the pyrolysis oil conversion plant is configured for reducing the inlet temperature to the second reactor, for increasing the pressure before the second reactor or for washing the outlet from the first reactor with an amount of water.

This has the associated benefit of providing a pyrolysis oil conversion plant with the ability to remove aromatic nitrogen efficiently from the pyrolysis oil.

A fourteenth aspect of the present disclosure relates to a pyrolysis plant, comprising a pyrolizer, a first reactor containing a material catalytically active in hydrotreatment, and a second reactor containing a material catalytically active in hydrodearomatization, wherein the pyrolizer is configured to provide a pyrolysis oil feedstock to the first reactor, wherein said second reactor is configured for receiving the outlet from the first reactor, and wherein the pyrolysis oil conversion plant is configured for reducing the inlet temperature to the second reactor, for increasing the pressure before the second reactor or for washing the outlet from the first reactor with an amount of water.

This has the associated benefit of providing a pyrolysis plant with the ability to remove aromatic nitrogen efficiently from the pyrolysis oil.

Liquid products from thermal decomposition, such as pyrolysis and thermal liquefaction, have, especially from a global warming perspective, been considered an environmentally friendly replacement for fossil products, especially after hydrotreatment. The nature of these products (for simplicity pyrolysis oil, irrespective of the originating process) will commonly be that they are rich in oxygenates and possibly olefins. The nature of formation means that the products are not stabilized, and therefore, contrary to typical fossil raw feedstocks, they may be very reactive, demanding high amounts of hydrogen, releasing significant amounts of heat during reaction and furthermore having a high propensity towards polymerization. The release of heat may increase the polymerization further, and at elevated temperature catalysts may also be deactivated by coking.

The thermal decomposition process plant section providing the feedstock according to the present disclosure may be in the form of a fluidized bed, transported bed, or circulating fluid bed, as is well known in the art. This decomposition converts a pyrolysis feedstock into a solid (char), a high boiling liquid (tar) and fraction being gaseous at elevated temperatures. The gaseous fraction comprises a fraction condensable at standard temperature (pyrolysis oil or condensate, C5+ compounds) and a non-condensable fraction (pyrolysis gas, including pyrolysis off-gas). For instance, the thermal decomposition process plant section (the pyrolysis section) may comprise a pyrolizer unit (pyrolysis reactor), cyclone(s) to remove particulate solids such as char, and a cooling unit for thereby producing pyrolysis off-gas stream and said pyrolysis oil stream, i.e. condensed pyrolysis oil. The pyrolysis off-gas stream comprises light hydrocarbons e.g. C1-C4 hydrocarbons, $H_2O$, CO and $CO_2$. Typically, the term pyrolysis oil comprises condensate and tar, and the pyrolysis oil stream from pyrolysis of biomass may also be referred to as bio-oil or bio-crude and is a liquid substance rich in blends of molecules, usually consisting of more than two hundred different compounds mainly oxygenates such as acids, sugars, alcohols, phenols, guaiacols, syringols, aldehydes, ketones, furans, and other mixed oxygenates, resulting from the depolymerisation of the solids treated in pyrolysis. Depending on the feedstock and the thermal decomposition method, corresponding nitrogenates may also be present in the pyrolysis oil. Nitrogenates are especially known to be present in pyrolysis oil from feedstocks such as algae, sewage sludge, digestate from biogas production, food waste and plastics, including polyurethane, polyamides and polyimides having nitrogen in their polymer structures, as well as other plastics comprising nitrogen containing additives. An analysis of the molecular composition of pyrolysis oil has proven difficult, due to the vast number of species. Still, an elemental analysis shows a C:H ratio indicating a high amount of aromatics, and when correlated with the C:N ratio it is plausible that the nitrogen is also bound in aromatic structures, which may be of a nature similar to quinoline and carbazole, but even larger aromatic structures comprising nitrogen are also assumed to be present in the pyrolysis oil.

For the purposes of the present invention, the pyrolysis section may be fast pyrolysis, also referred to in the art as flash pyrolysis. Fast pyrolysis means the thermal decomposition of a solid renewable feedstock typically in the absence of oxygen, at temperatures typically in the range 350-650° C. e.g. about 500° C. and reaction times of 10 seconds or less, such as 5 seconds or less, e.g. about 2 sec. Fast pyrolysis may for instance be conducted by autothermal operation e.g. in a fluidized bed reactor. The latter is also referred to as autothermal pyrolysis and is characterized by employing air, optionally with an inert gas or recycle gas, as the fluidizing gas. Thereby, the partial oxidation of pyrolysis compounds being produced in the pyrolysis reactor (autothermal reactor) provides the energy for pyrolysis while at the same time improving heat transfer. In so-called catalytic fast pyrolysis, a catalyst may be used. An acid catalyst may be used to upgrade the pyrolysis vapors, and it can both be operated in an in-situ mode (the catalyst is located in the pyrolysis reactor) and an ex-situ mode (the catalyst is placed in a separate reactor). The use of a catalyst conveys the advantage of removing oxygen and thereby helping to stabilize the pyrolysis oil, thus making it easier to hydroprocess. In addition, increased selectivity towards desired pyrolysis oil compounds may be achieved.

In some cases, hydrogen is added to the catalytic pyrolysis which is called reactive catalytic fast pyrolysis. If the catalytic pyrolysis is conducted at a high hydrogen pressure, such as above 0.5 MPa, it is often called catalytic hydropyrolysis.

The pyrolysis stage may be fast pyrolysis which is conducted without the presence of a catalyst and hydrogen, i.e. the fast pyrolysis stage is not catalytic fast pyrolysis, hydropyrolysis or catalytic hydropyrolysis. This enables a much simpler and inexpensive process.

The thermal decomposition section may also be hydrothermal liquefaction. Hydrothermal liquefaction means the thermochemical conversion of biomass into liquid fuels by processing in a hot, pressurized water environment for sufficient time to break down the solid biopolymeric structure to mainly liquid components. Typical hydrothermal processing conditions are temperatures in the range of 250-425° C. and operating pressures in the range of 4 Mpa to-35 MPa or even 40 MPa. This technology offers the advantage of operation of a lower temperature, higher energy efficiency and producing a product with a lower oxygen content compared to pyrolysis, e.g. fast pyrolysis.

Finally, other relevant thermal decomposition methods are intermediate or slow pyrolysis, in which the conditions involve a lower temperature and commonly higher residence times—these methods may also be known as carbonization or torrefaction. The major benefit of these thermal decomposition methods is a lower investment, but they may also have specific benefits for specific feedstocks or for specific product requirements, such a need for bio-char.

The conversion of oxygenates to hydrocarbons is a common process for production of renewable transportation fuels, but the reactivity and other specifics differ for different feedstocks. The pyrolysis oil typically comprises one or more oxygenates taken from the group consisting of ketones, aldehydes or alcohols, and may originate from thermal decomposition of plants, algae, animals, fish, vegetable oil refining, other biological sources, domestic waste, industrial biological waste like tall oil or black liquor as well as non-biological waste comprising suitable compositions, such as plastic fractions or rubber, including used tires, typically after a thermal and/or catalytic degradation process. When the feedstock is of biological origin, the feedstock and the product will be characterized by having a 14C content above 0.5 parts per trillion of the total carbon content, but when the feedstock includes waste of fossil origin, such as plastic, this ratio may be different.

The production of hydrocarbon products typically requires one or more hydroprocessing steps which most commonly are; hydrotreatment for removing heteroatoms and saturating double bonds, hydroisomerization for adjusting hydrocarbon molecule structure and hydrocracking for reducing hydrocarbon molecular weight, and according to the present disclosure, hydrodearomatization is also of relevance, also for the purpose of removing aromatically bound heteroatoms, such as nitrogen.

During hydrotreatment, oxygenates are combined with an excess of hydrogen and react in hydrodeoxygenation processes as well as in decarboxylation and decarbonylation processes, where water, carbon dioxide and carbon monoxide are released from the oxygenates, and an amount of carbon dioxide is converted to carbon monoxide by the water/gas shift process. Typically, from 5 wt % or 10 wt % to 50 wt % of the oxygenate feedstock is oxygen, and thus a significant amount of the product stream will be water, carbon dioxide and carbon monoxide. In addition, an amount of light hydrocarbons may also be present in the product stream, depending on the nature of the feedstock and the side reactions occurring. Hydrotreatment may also involve extraction of other hetero-atoms, notably nitrogen and sulfur but possibly also halogens and silicon as well as saturation of double bonds. Especially the hydrotreatment of oxygenates is very reactive and exothermal, and moderate or low activity catalysts may be preferred to avoid excessive heat release and runaway reactions resulting in coke formation deactivating the catalyst. The catalyst activity is commonly controlled by only using low amounts of active metals and especially limiting the amount of promoting metals, such as nickel and cobalt.

Typically, hydrotreatment, such as deoxygenation and hydrogenation, involves directing the feedstock stream comprising oxygenates to contact a catalytically active material comprising sulfided molybdenum, or possibly tungsten, and/or nickel or cobalt, supported on a carrier comprising one or more refractory oxides, typically alumina, but possibly silica or titania. The support is typically amorphous. The catalytically active material may comprise further components, such as boron or phosphorous. The conditions are typically a temperature in the interval 250-400° C., a pressure in the interval 3-15 MPa, a gas to oil ratio of 200-2000 $Nm^3/m^3$ and a liquid hourly space velocity (LHSV) in the interval 0.1-2. The deoxygenation will involve a combination of hydrodeoxygenation producing water and if the oxygenates comprise carboxylic groups such as acids or esters, decarboxylation producing $CO_2$. The deoxygenation of carboxylic groups may proceed by hydrodeoxygenation or decarboxylation with a selectivity which, depending on conditions and the nature of the catalytically active material may vary from above 90% hydrodeoxygenation to above 90% decarboxylation. Deoxygenation by both routes is exothermal, and with the presence of a high amount of oxygen, the process may involve intermediate cooling e.g. by quenching with cold hydrogen, feed or product. The feedstock may preferably contain an amount of sulfur to maintain sulfidation of the metals, in order to maintain their activity. If the feedstock stream comprising oxygenates comprises less than 10, 100 or 500 $ppm_w$ sulfur, a sulfide donor, such as dimethyldisulfide (DMDS) has typically been added to the feed.

If the unstabilized feedstock is highly reactive, a pre-treatment at moderate conditions may be relevant, to stabilize the feedstock. This may involve an inlet temperature as low as 80° C., 120° C. or 200° C., a pressure in the interval 2-15 MPa, a gas to oil ratio of 200-1000 $Nm^3/m^3$ and a liquid hourly space velocity (LHSV) in the interval 0.1-2 and a deliberate choice of less active catalytically active material, such as unpromoted molybdenum. Due to the reactive components and the exothermal nature thermal control may be relevant in this pre-treatment step.

When the heteroatom to be removed is nitrogen, it has often been found that more severe conditions (higher temperature, higher hydrogen pressure, more active catalyst) are required, compared to removal of oxygen and sulfur. In hydroprocessing of fossil feedstocks comprising organically bound nitrogen, it has also been found that hydrocracking processes were required for deep hydrodenitrogenation, i.e. conversion over a material catalytically active in hydrocracking at active hydrocracking conditions. As hydrocracking is not fully selective, such a step will involve Under the conditions in the HDO reactor, the equilibrium of the water gas shift process causes a conversion of $CO_2$ and $H_2$ to CO and $H_2O$. In the presence of the base metal catalyst an amount of methanation may take place, converting CO and $H_2$ to $CH_4$ and $H_2O$.

Depending on the structure of the feedstock, the deoxygenation process may provide a product rich in linear alkanes, having poor cold flow properties, and therefore the deoxygenation process may be combined with a hydroisomerization process, with the aim of improving the cold flow properties of products, and/or a hydrocracking process, with the main aim of adjusting the boiling point of products.

The material catalytically active in isomerization typically comprises an active metal (either elemental noble metals such as platinum and/or palladium or sulfided base metals such as nickel, cobalt, tungsten and/or molybdenum), an acidic support (typically a molecular sieve showing high shape selectivity, and having a topology such as MOR, FER, MRE, MWW, AEL, TON and MTT) and a refractory support (such as alumina, silica or titania, or combinations thereof).

Isomerization conditions involve a temperature in the interval 250-400° C., a pressure in the interval 2-10 MPa, a gas to oil ratio of 200-2000 $Nm^3/m^3$ and a liquid hourly space velocity (LHSV) in the interval 0.5-8.

Hydrocracking will adjust the cold flow properties as well as the boiling point characteristics of a hydrocarbon mixture, by cracking large molecules into smaller. Typically, hydrocracking involves directing an intermediate feedstock to contact a material catalytically active in hydrocracking comprising an active metal (either elemental noble metals such as platinum and/or palladium or sulfided base metals such as nickel, cobalt, tungsten and/or molybdenum), an acidic support (typically a molecular sieve showing high cracking activity, and having a topology such as MFI, BEA and FAU, but possibly also silica-alumina) and a refractory support (such as alumina, silica or titania, or combinations thereof). The catalytically active material may comprise further components, such as boron or phosphorous. While this overall composition is similar to the material catalytically active isomerization the difference is typically the nature of the acidic support, which may be of a different structure (even amorphous silica-alumina) or have a different-typically higher-acidity e.g. due to silica:alumina ratio. The conditions are typically a temperature in the interval 250-400° C., which typically is higher temperatures than corresponding isomerization temperatures, a pressure in the interval 3-15 MPa, and a liquid hourly space velocity (LHSV) in the interval 0.5-8, optionally together with intermediate cooling by quenching with cold hydrogen, feed or product.

The composition of pyrolysis oils is defined by the raw material as well as the pyrolysis process. For many process this means that the pyrolysis oil contains only a moderate amount of high boiling material, and therefore the required hydrocracking conditions may be moderate, and involve little or no recycle. However, some thermal decomposition processes, especially those producing nitrogen rich pyrolysis oil may provide pyrolysis oil with a significant amount of product boiling above 350° C., and thus may require product recycle. Due to the aromatic nature of pyrolysis oil recycle could lead to formation of polynuclear aromatics, and known solutions to this challenge in refinery processes may have to be implemented.

When the hydrocarbon material contains aromatics, removal of these may be desired for various reasons, including removal of aromatically bound heteroatoms, and a material highly active in hydrotreatment is commonly used for this purpose, to minimize the kinetic limitations, in order reduce the temperature. The material catalytically active in hydrodearomatization typically comprises an active metal (either promoted sulfided base metals such as tungsten and/or molybdenum promoted by nickel or cobalt, where the gas phase associated with the streams to hydrodearomatization preferably contains at least 50 $ppm_v$ sulfur or—optionally after purification, by removal of e.g. hydrogen sulfide—noble metals such as platinum and/or palladium) and a refractory support (such as amorphous silica-alumina, alumina, silica, titania or molecular sieves, or combinations thereof). Hydrodearomatization is equilibrium controlled, with high temperatures favoring aromatics, and therefore noble metals are commonly preferred as the active metal, since they are active at lower temperatures, compared to base metals. The material catalytically active in hydrodearomatization typically comprises an elevated amount of active metals compared to regular hydrotreatment catalysts, such as from at least 0.1 wt %, at least 0.5 wt % or at least 1 wt %, to 3 wt % Pt or Pd noble metal or from at least 1 wt %, at least 5 wt % or at least 15 wt % to at most 20 wt %, at most 30 wt % or at most 50 wt % molybdenum or tungsten, promoted by an amount of nickel in the range from 0.1:1 Ni:Mo+W to 2:1 Ni:Mo+W (where the ratios designate molar ratios between the amount of Ni and the total amount of Mo and W) on a refractory oxidic support such as alumina, silica, titania or molecular sieves. The hydrodearomatization catalyst may also comprise only Ni in reduced form as active metal on a refractory support or may be an unsupported bulk catalyst comprising at least 50% sulfided Mo and or W.

Typically, hydrodearomatization involves directing an intermediate product to contact a material catalytically active in hydrodearomatization. As mentioned the equilibrium between aromatics and saturated molecules shifts towards aromatics at elevated temperatures, so it is preferred that the temperature is moderate. The conditions are typically a temperature in the interval 200-350° C., a pressure in the interval 2-10 MPa, a gas to oil ratio of 200-2000 $Nm^3/m^3$ and a liquid hourly space velocity (LHSV) in the interval 0.5-8. As mentioned, commonly the preferred active metal(s) on the material catalytically active in hydrodearomatization are noble metal(s), to benefit from low temperature equilibirium. According to the present disclosure, the intermediate downstream fractionation or stripping are typically sufficiently purified, so with hydrodearomatization in that position, the active metal(s) in the material catalytically active in hydrodearomatization may be noble metals. However, if purification is not desired in a relevant position, base metal catalysts may also be used, and in this case the gas phase associated with the streams to hydrodearomatization preferably contains at least 50 $ppm_v$ sulfur. When nitrogen forms part of the aromatic structure, hydrodearomatization may make the nitrogen accessible to hydrotreatment, and therefore assist in denitrogenation.

As hydrotreatment processes are controlled by multiple parameters, including pressure, temperature, space velocity, hydrogen partial pressure, feedstock composition, catalyst composition, nano-structure of the catalyst including surface area and pore size distribution, a functional definition of hydrodearomatization is beneficial for the understanding of the present disclosure. In accordance with the general understanding of the skilled person in the field, active in hydrodearomatization may be understood as a process in which at least 10% of the aromatic bonds are saturated, without substantial structural changes to the hydrocarbon structure. Preferably, without substantial structural changes to the hydrocarbon structure shall be understood as less than 10% of the carbon-carbon bonds in the feedstock being broken. While these definitions make sense from the perspective of chemical reactions, it may be preferred to employ definitions based on standard analytical methods in the field.

The combination of conditions, composition and structure of catalytically active materials and feedstocks makes it difficult to objectively define whether a given combination results in a specific process. The skilled person is aware of this and will from inspection of conditions and catalytically active material commonly understand the nature of the process, and his evaluation may be supported by simple and accessible experimental evaluations, which may be determined either from a specific feed or for a model compound, involving commonly available analytical equipment and laboratory facilities. The extent of hydrotreatment may be determined by directing a feed to contact a catalytically active material under a set of conditions. The relative amount of heteroatoms removed as calculated from the organically bound heteroatoms in the feed and the organically bound heteroatoms in the product, defines the extent of hydrotreatment for said combination of conditions and catalytically active material. This extent of hydrotreatment may be determined for oxygen—i.e. hydrodeoxygenation, for nitrogen—i.e. hydrodenitrogenation, sulfur—i.e. hydrodesulfurization and individual or total metals—i.e hydrodemetallization. In the excess of hydrogen, reaction to equilibrium would imply full conversion by hydrotreatment. Active hydrotreatment may imply conditions and catalytically active material under which the extent of hydrotreatment is at least 10%. The evaluation would however require that the molecular structures do not block conversion, e.g. by sterical hindrance, and therefore a specific experimental evaluation of hydrotreatment at a combination of catalytically active material, conditions and feedstocks is best made with a substituted alkane with no rings or a single ring structure.

The extent of hydrodearomatization may be determined by directing a feed to contact a catalytically active material under a set of conditions. The relative removed amount of total aromatics, calculated from the concentration of total aromatics in the product and the concentration of total aromatics in the feed, defines the extent of hydrodearomatization for said combination of conditions and catalytically active material. A relevant model compound may be 30% naphthalene in heptane, and the content of aromatics may be determined according to ASTM D-6591. Commonly full hydrodearomatization is not expected, since the reaction is limited by equilibrium, so more than 10% hydrodearomatization is considered active from an industrial perspective.

The extent of hydrodenitrogenation may be determined by directing a feed to contact a catalytically active material under a set of conditions. The relative removed amount of organically bound nitrogen calculated from the organically bound nitrogen in the feed converted and the ammonia produced, defines the extent of hydrodenitrogenation for said combination of conditions and catalytically active material. A relevant model compound may be 1% aromatic carbazole and 1% N substituted hexadecane in n-hexadecane. Hydrodenitrogenation by hydrotreatment would be assumed active if at least 10% the non-aromatic nitrogen is released as ammonia.

The extent of hydrocracking may be determined by directing a feed to contact a catalytically active material under a set of conditions. The relative amount of material converted from boiling above a given temperature such as 370° C. to boiling below said given temperature 370° C., defines the extent of hydrocracking for said combination of conditions and catalytically active material. A relevant model compound would be a feed comprising a range of compounds, since with a single compound a realistic measure of the extent of hydrocracking is not obtained. In the excess of hydrogen, reaction to equilibrium would imply full conversion by hydrocracking, but in practice conditions are chosen as less severe such that conversion is limited, because this enables better control of the process. Increased total hydrocracking conversion may be obtained by recycling the heavy part of the product.

The extent of isomerization may be determined by directing a feed to contact a catalytically active material under a set of conditions. The relative amount of material converted from n-paraffins to branched paraffins with the same number of carbon atoms, defines the extent of isomerization for said combination of conditions and catalytically active material. A relevant model compound may be n-hexadecane. Alternatively a catalytically active material and conditions active in isomerization may also be determined by improved cold flow properties (i.e. a decrease of pour point or cloud point of at least 5° C.), with an increase in hydrocarbon hydrogen content of less than 0.5 wt %.

The term "dominating reaction" of a feedstock in the presence of a material catalytically active under active reaction conditions shall imply that under the specified set of conditions, the specific dominating reaction is the reaction having the highest extent of reaction, as determined above.

A combination of feedstock, catalytically active material and conditions is, unless otherwise stated, considered active for a given reaction if the extent of this reaction is above 10%. By this measure, more than one reaction may be active at the same combination of catalytically active material, conditions and feedstock.

Commonly, the reactions may show a higher extent with more severe conditions (i.e. higher temperature, higher amount of catalytically active composition), but for some reactions the equilibrium between reactants and products may also control the extent of reactions. Finally, the different trends may also mean that as the severity changes, the dominating reaction changes. As an example, a material catalytically selective towards isomerization, will in the excess of hydrogen and at high severity, catalyze hydrocracking reactions and therefore for the same material selectivity between isomerization and hydrocracking may change. The conditions for which the selectivity changes will differ by the catalytically active material.

The limiting step for hydrotreatment and hydroprocessing is typically kinetic, which supports increasing the process severity, e.g. by increasing temperature, hydrogen pressure and active metal availability in the catalytically active material, but for hydrodearomatization, the reaction is limited by thermodynamic equilibrium, which at high temperatures favors aromatics over non-aromatics. Therefore, the realization that nitrogen compounds in the pyrolysis oil may be in the form of aromatic compounds leads to a proposed process involving a combination of a hydrotreatment process step at high temperature aiming at minimizing kinetic limitations, prior to a hydrodearomatization process step with the aim of removing aromatic nitrogen at lower temperature, possibly followed by further hydroprocessing. While hydrodearomatization is commonly conducted in the presence of catalytically active material comprising noble metals, the presence of nitrogen in the aromatics means that base metals will often be preferred, although this may work against the commonly preferred low temperature operation of hydrodearomatization, practiced with noble metals. To minimize the exothermal hydrotreatment reactions, and thus maintaining a moderate temperature favoring hydrodearomatization, the high amount of heteroatoms is preferably removed prior to the contact with the highly active material catalytically active in hydrodearomatization, such that the amount of heteroatoms in the fraction of the hydrotreated intermediate directed to hydrodearomatization is less than 2 wt %, less than 1 wt % or 0.5 wt %.

An analysis assuming reaction to equilibrium in the conversion of carbazole and quinoline respectively was made under two sets of conditions; (a) T=400° C., p=8 MPa and (b) T=320° C., p=15 MPa. For actual pyrolysis oils, even larger hetero-aromatic molecules would be present, and the effect would be larger.

Carbazole reacts according to the following mechanism:

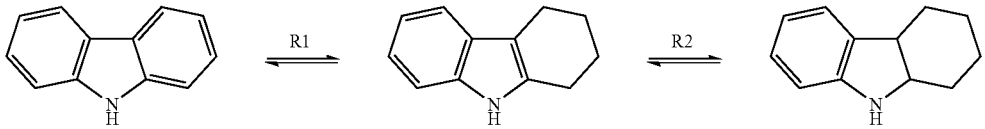

According to this mechanism, tri-aromatic carbazole (left) is in equilibrium with di-aromatic 2,3,4,9-Tetrahydrocarbazole (center) and mono-aromatic 2,3,4,4a,9,9a-Hexahydrocarbazole (right). All three molecules contain nitrogen, but in 2,3,4,4a,9,9a-Hexahydrocarbazole the nitrogen is not part of an aromatic structure, and thus the non-aromatic nitrogen is relatively reactive, and easily removed by reaction with hydrogen in the presence of the active material catalytically active in hydrodearomatization.

A compound analysis of the mentioned equilibria is shown in Table 1, showing that the equilibrium is pushed from the tri-aromatic carbazole to mono-aromatic 2,3,4,4a, 9,9a-Hexahydrocarbazole in both equilibria. Therefore, by choosing conditions (a), the equilibrium will favor carbazole, and thus limit the denitrogenation significantly compared to conditions (b), since a high amount of nitrogen is kept in the refractive aromatic structure by the compounded equilibrium at conditions (a).

Similarly, quinoline reacts according to the following mechanism:

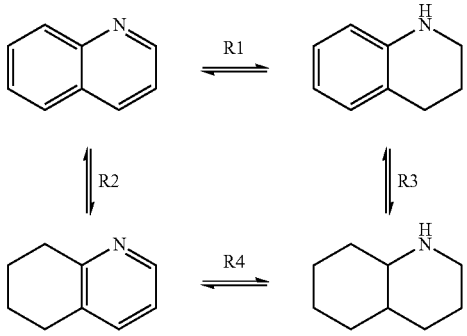

For simplicity analysis is limited to R1, R2, R3 and R4; reactions involving quinoline and compounds with nitrogen atoms forming part of a two-ring structure, considering the overall equilibrium between aromatic nitrogen compounds and non-aromatic nitrogen compounds.

A compound analysis of these four equilibria is shown in Table 2, showing that the equilibrium is pushed from the di-aromatic quinoline to the mono-aromatic without aromatic derivatives and further to the non-aromatic nitrogen in the four equilibria. Therefore, by choosing conditions (a), the equilibrium will favor quinoline, and thus limit the denitrogenation significantly compared to conditions (b), since a high amount of nitrogen is kept in the aromatic structure of quinoline by the compounded equilibrium at conditions (a), whereas at conditions (b) almost quantitative conversion to the compounds without aromatic nitrogen.

In both cases the conversion of aromatic nitrogen to a non-aromatic structure at low temperature and high pressure has the effect of increasing the potential conversion. The effect is also obtained by only applying low temperature, but is further enhanced if the pressure is elevated, e.g. to a level 2 MPa or 5 MPa above the pressure used for regular hydrotreatment. Since the non-aromatic nitrogen compounds are less stable than the aromatic compounds, the conditions (b) will be sufficient for hydrodenitrogenation of the non-aromatic nitrogen, and thus conditions (b) will contribute to removal of nitrogen from quinoline and carbazole, compared to conditions (a) as the initial equilibria are shifted towards less stable compounds in an amount sufficient for extensive conversion. In addition the equilibrium may also be shifted by removing ammonia, by addition of wash water and separation of water in a flash step. If the flash step is carried out around 50° C., a high amount of ammonia may be withdrawn, without altering the process pressure, which allows a simpler process. Since the feedstocks treated in the present process contain a very high amount of ammonia, it may be of commercial value to selectively withdraw and purify ammonia for commercial use. This may also involve ammonia cracking, to provide hydrogen for the process, or use as fertilizer or in production of fertilizer.

A hydroprocessed stream comprising hydrocarbons, excess hydrogen and inorganic molecules comprising heteroatoms must be separated in hydrocarbons and molecules—typically gases—comprising heteroatoms. To do this, the hydroprocessed stream is directed to a separation section, which for process scenarios relating to the treatment of pyrolysis oil typically either will be between a base metal based hydrotreatment reactor and a noble metal based hydrodearomatization reactor, or if the material catalytically active in hydrodearomatization comprises base metals, downstream the hydrodearomatization reactor. The process may also comprise one or more other conversion steps, such as hydrocracking or hydroisomerization, and depending on the sequence of these steps and the catalytically active metals used, the skilled person will be aware of the possible positions for introducing a separation section with the purpose of withdrawing a recycle gas stream.

As the development of heat and the consumption of hydrogen is high in processes treating feedstocks rich in oxygenates and comprising other hetero-atoms than oxygen, the gas to oil ratio in the hydroprocessing reactors is also very high compared to other hydroprocessing processes, such as from 1000 to 7000 $Nm^3/m^3$. This hydrogen gas may be used to control process temperatures, by stepwise injections of cooled gas.

The pyrolysis oil product streams may contain aromatic hydrocarbons, long linear hydrocarbons, gaseous hydrocarbons, water and to some extent carbon oxides, and in addition nitrogen in the hydrocarbonaceous feedstock will result in ammonia in the hydroprocessed stream. Added sulfur as well as any sulfur in the pyrolysis oil will be present as hydrogen sulfide in the hydroprocessed stream, and finally an excess amount of hydrogen will pass unreacted to the hydroprocessed stream. Intermediate separation steps may be required for optimal handling of this diverse mixture, so especially if hydrodearomatization is carried out using a catalytically active material comprising noble metals, "sour gases", including hydrogen sulfide, carbon dioxide and ammonia, are removed prior to these reactions.

In addition, the necessity to combine 3 or 4 catalytically active materials for optimal conversion of pyrolysis oil into hydrocarbons naturally complicates the process layout, and the sequence of the materials must be considered carefully, especially concerning the presence of sulfur required for base metals and shunned for noble metals.

In the process layouts, recycle may be used for different purposes; gas recycle for efficient use of hydrogen, liquid recycle around the material catalytically active in hydrocracking to maximize the yield of the desired fraction and liquid recycle around the material catalytically active in hydrodeoxygenation to limit the temperature increase due to exothermal deoxygenation reactions as well as to limit the reaction rate of polymerization reactions for reactive oxygenates and other reactive compounds in the pyrolysis oil. The choice of recycle configuration will be related to different benefits, including process simplicity by minimizing the number of recycle loops, minimizing reactor volume and cost by choosing configurations with low recycle volumes, maximizing process reactivity control by high recycle volume and/or extensive cooling, and minimizing polymerization by high recycle volume.

Process configurations without recycle may also be beneficial due to simplicity and low cost, especially in the cases where the process volume is moderate.

The figures mainly illustrate the hydrocarbon and liquid flows of the process, and the skilled person will be aware that hydrogen addition, even though not shown, will be required in the process. For economical reasons hydrogen rich gas stream(s) may also be recycled, optionally after purification. In a similar manner, process conditions such as temperature and pressure may also be relevant to control, and this may be done by equipment not shown, such as air coolers, fired heaters and heat exchangers, as well as pumps and compressors. The skilled person will also be aware of other elements in the process not shown in the figures, with practical relevance for the process but with limited specific relevance for the invention, and furthermore specific configurations such as recycle streams may be shown, but alternative implementations may be possible with no detriment to the invention. Furthermore, liquid recycles may also be present, although not shown in the figures. Where reference is made to fractionation, this may be a simple gas liquid separation, a stripper or a more extensive fractionation section comprising gas/liquid separators and a distillation unit.

Figure 1:
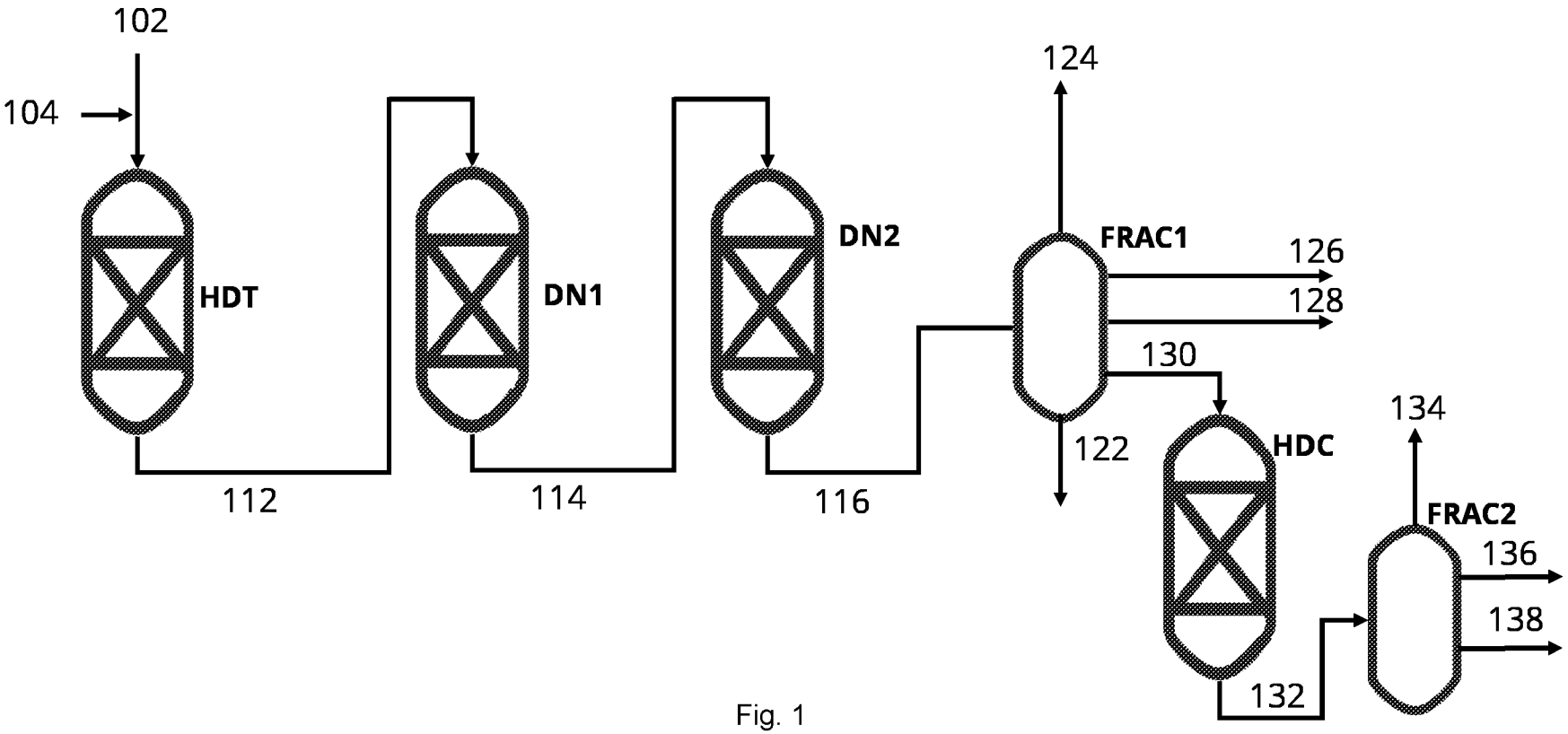
FIG. 1 illustrates a process according to the present disclosure, employing two catalytically active materials for removal of nitrogen, both comprising sulfided base metals, and one being catalytically active in hydrotreating and the other being catalytically active in hydrodearomatization.

The process shown in FIG. 1 illustrates a combined stream of feedstock (102) and a hydrogen rich gas (104) being directed to a hydrotreatment reactor (HDT), in which hydrotreatment processes, such as hydrodeoxygenation and hydrodemetallization may also take place. The hydrotreated intermediate (112) is directed to a first denitrogenation reactor (DN1) containing a material catalytically active in hydrotreatment operating under hydrotreatment conditions, providing a further hydrotreated intermediate (114). The further hydrotreated intermediate (114) is directed to a second denitrogenation reactor (DN2) containing a material catalytically active in hydrodearomatization operating under hydrodearomatization conditions, which typically involves a catalytically active material with higher amounts of active metal compared to the material catalytically active in hydrotreatment, and often a lower temperature. The effluent (116) of the second denitrogenation reactor (DN2) is directed to a fractionation or seperation section (FRAC1), here shown to separate the effluent (116) in a heavy bottom fraction (122) and an off-gas (124) which are directed to further processing, a naphtha fraction (126) and a light diesel fraction (128) which may be withdrawn as products and an intermediate heavy fraction (130) which is directed to a reactor comprising a material catalytically active in hydrocracking (HDC), to provide a hydrocracked product. Commonly the feedstock comprises oxygenates, and in that case condensed water would also be withdrawn in a separator in the fractionation section (FRAC1), and if wash water was injected upstream the fractionation section to remove ammonia, it would also be withdrawn in this position. The hydrocracked product is directed to a second fractionation section (FRAC2), for separation in an off-gas (134), a second naphtha fraction (136) and a second diesel fraction (138). By this configuration, only the intermediate heavy fraction (130) is hydrocracked, which avoids a yield loss from hydrocracking light diesel (128) and naphtha quality loss from ring opening the naphtha fraction (126), and it also avoids the risk of formation of heavy polynuclear aromatics (HPNA) from hydrocracking of the heavy bottom fraction (122). An alternative process scheme in which the heavy bottom fraction is directed to hydrocracking is possible. A heavy bottom hydrocracked fraction may also be recycled from the second fractionator section to the hydrocracker (HDC), which would enable a high total conversion in the hydrocracker, while limiting the severity of the conditions.

In the embodiment illustrated in FIG. 1, cooling by heat exchange prior to the material catalytically active in hydrodearomatization (DN2) is not shown explicitly, but commonly the temperature is regulated by heat exchange with another process stream or steam. The cooling of the stream may also be carried out by liquid quench or gas quench, and process configurations may also exist in which such cooling is not needed. A stream outlet from the fractionator (FRAC1) may be useful in this respect, and also have a temperature such that the mixed stream to DN2 will have the appropriate reduced temperature to favour hydrodearomatization.

Figure 2:
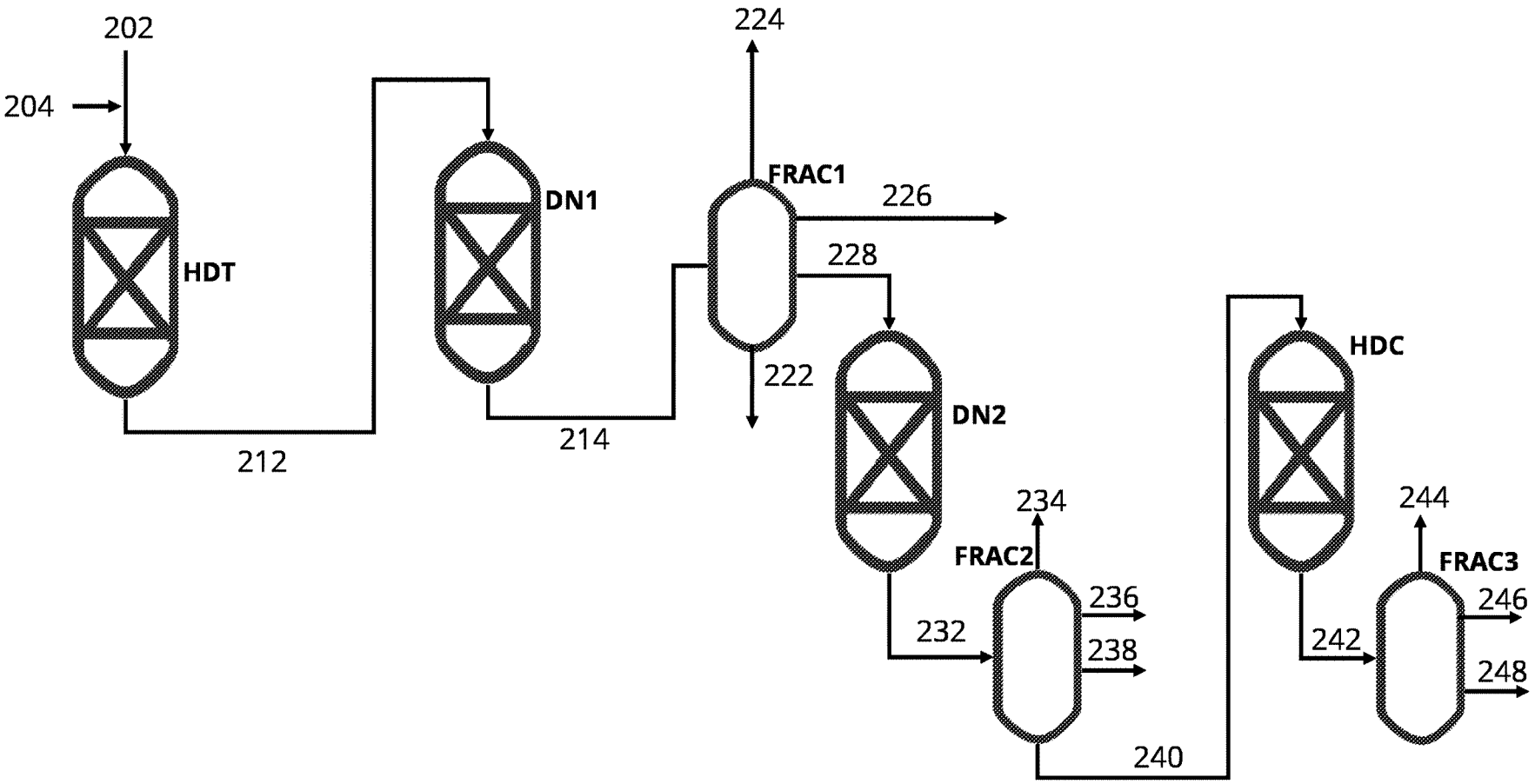
FIG. 2 illustrates a process according to the present disclosure, employing two catalytically active materials for removal of nitrogen, one comprising sulfided base metals, and being catalytically active in hydrotreating and the other comprising noble metals and being catalytically active in hydrodearomatization.

The process shown in FIG. 2 is a variant embodiment of the one of FIG. 1 illustrating a process requiring absence of water, ammonia and hydrogen sulfide as would be the case for the use of a material catalytically active in hydrodearomatization, comprising a noble metal, or a process in which an intermediate stream is taken out for other purposes. Here a combined stream of feedstock (202) and a hydrogen rich gas (204) is directed to a hydrotreatment reactor (HDT), in which hydrotreatment processes, such as hydrodeoxygenation and hydrodemetallization may also take place. The hydrotreated intermediate (212) is directed to a first denitrogenation reactor (DN1) containing a material catalytically active in hydrotreatment operating under hydrotreatment conditions, providing a further hydrotreated intermediate (214). The further hydrotreated intermediate (214) is directed to a first fractionation section, here shown to separate the hydrotreated intermediate (214) in a heavy bottom fraction (222), an off-gas fraction (224), a first naphtha fraction (226) and an intermediate heavy fraction (228). As for FIG. 1 the feedstock may commonly comprise oxygenates, and in that case condensed water would also be withdrawn in a separator in the fractionation section (FRAC1). If it is desired to shift the equilibrium by removal of ammonia, an amount of water may also be added to the further hydrotreated intermediate (214), such that the ammonia is dissolved in the water, and withdrawn by separation. The intermediate heavy fraction is after addition of hydrogen (not shown) directed to a second denitrogenation reactor (DN2) containing a material catalytically active in hydrodearomatization operating under hydrodearomatization conditions, which typically involves a catalytically active material with higher amounts of active metal compared to the material catalytically active in hydrotreatment, and often a lower temperature. As off-gas (224) has been removed, the material catalytically active in hydrodearomatization may comprise noble metals, which enables operation at a lower temperature resulting in a higher degree of dearomatization, and thus higher nitrogen removal. The denitrified stream (232) is directed to a second fractionation section (FRAC2), here separating the denitrified stream in off gas (234), a second naphtha fraction (236), a light diesel fraction (238) and a heavy diesel fraction (240). The heavy diesel fraction (240) is after addition of hydrogen (not shown) directed to a reactor containing a material catalytically active in hydrocracking (HDC), to provide a hydrocracked product, which is directed to a third fractionation section (FRAC3), for separation in an off-gas (244), a hydrocracked naphtha fraction (246) and a hydrocracked diesel fraction (248). By this configuration, only the intermediate heavy fraction (228) is hydrocracked, which avoids a loss of aromatics and thus octane number from the first naphtha fraction (226). Furthermore, it enables the use of more efficient noble metals in the material catalytically active in hydrodearomatization (DN2), thus providing a deeper denitrogenation.

The second fractionation section (FRAC2) is here shown to fractionate the liquid product, but it may also be a simple hot stripper, as the most important function is to remove ammonia to avoid deactivation of the material catalytically active in hydrocracking by ammonia released during denitrogenation.

Figure 3:
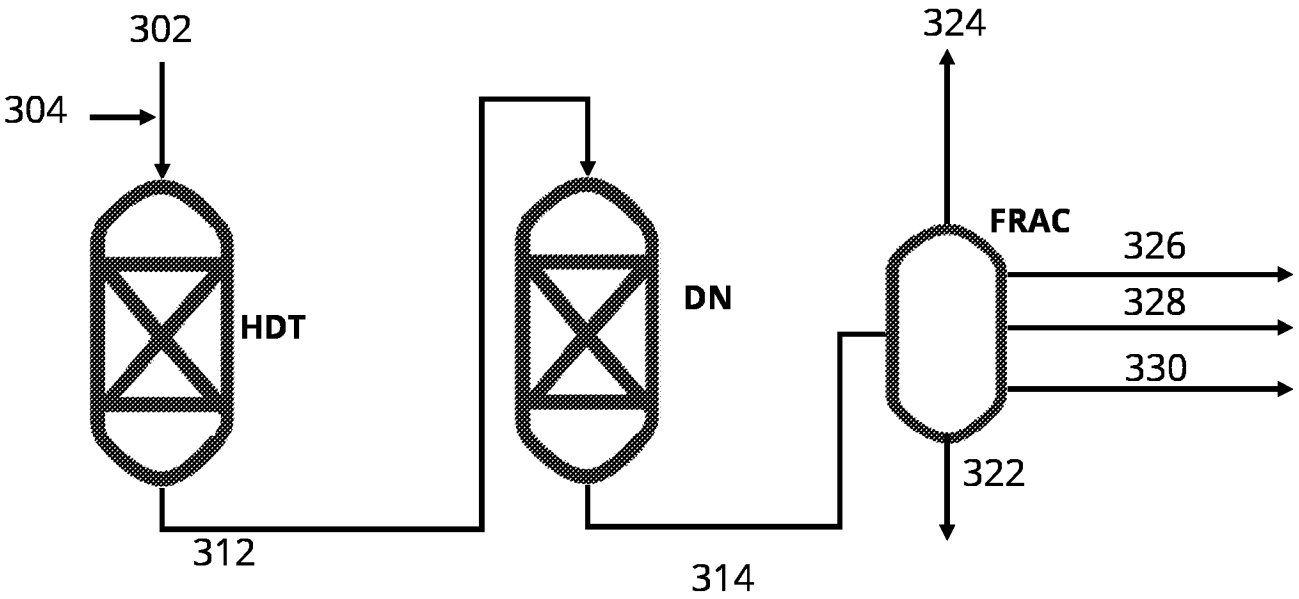
FIG. 3 illustrates a process according to the prior art, employing a material catalytically active in hydrotreatment for removal of nitrogen comprising sulfided base metal.

In FIG. 3, a process according to the prior art is shown. Here a combined stream of feedstock (302) and a hydrogen rich gas (304) is directed to a hydrotreatment reactor (HDT), in which hydrotreatment processes, such as hydrodeoxygenation and hydrodemetallization may also take place. The hydrotreated intermediate (312) is directed to a first denitrogenation reactor (DN) containing high activity material catalytically active in hydrotreatment operating under severe hydrotreatment conditions, such as a temperature up to 425° C., providing a further hydrotreated intermediate (314). The further hydrotreated intermediate (314) is directed to a fractionation section (FRAC), separating the hydrotreated intermediate (314) in a heavy bottom fraction (322), an off-gas fraction (324), a first naphtha fraction (326) and an intermediate heavy fraction (328).

EXAMPLE 1

Processes according to the illustration in FIG. 1, FIG. 2 and FIG. 3 are compared in the following, and compositions of streams are presented in Table 3 and Table 4.

All processes are carried out assuming a feedstock according to Table 3, which is an example corresponding to a feedstock produced by hydrothermal liquefaction of algae material.

Table 4 compares the mass flow and percentage of nitrogen in key streams of FIG. 1-3.

The amounts and qualities of products in FIGS. 1 and 2 are similar; the naphtha and diesel yields are 24 and 60 ton/h respectively, and the nitrogen content is 2 wt ppm in diesel fraction. The process of FIG. 1 will have the benefit of a simpler process, while the process of FIG. 2 will have the benefit of a smaller DN2 reactor, as the reactor is not required to treat the naphtha. In addition, the withdrawal of naphtha upstream the material catalytically active in hydrodearomatization will maintain a higher octane number of the naphtha. It is estimated that for FIG. 1, RON will be 75, whereas for FIG. 2 and FIG. 3 it will 85. Furthermore, a majority of $NH_3$ is removed in FRAC1 prior to DN2, which may also improve catalyst activity, and thus contribute to a lower reactor volume.

The concept according to the prior art, shown in FIG. 3 gives a naphtha yield of 17 ton/h with a nitrogen content of 9 wt ppm, a diesel yield of 47 ton/h with a nitrogen content of 2.0 wt %, and a heavy yield of 21 ton/h with a nitrogen content of 3.0 wt %. Due to the high content of nitrogen in the heavy fraction, this fraction is not suited for further treatment by hydrocracking, as ammonia as well as organic nitrogen compounds inhibit hydrocracking.

EXAMPLE 2

Example 2 is similar to Example 1, but shows the treatment of a sewage sludge derived pyrolysis oil in the three processes according to FIGS. 1-3.

Table 5 shows the characteristics of a pre-treated feedstock to the process indicated in FIGS. 1-3 and Table 6 shows the mass flow and percentage of nitrogen in key streams.

The qualitative trends are similar to the trends for algae derived oil, but the results indicate a higher residue of nitrogen in the products, although still in compliance with specifications.

EXAMPLE 3

Table 7 shows the feed and product characteristics from a pilot plant experiment corresponding to FIG. 2, excluding the second fractionation section and the reactor containing a material catalytically active in hydrocracking. It is clear from the table that increasing the temperature in the second reactor to 380 to 400° C. does not decrease the N content in the product, hence indicating that the nitrogen removal at this temperature becomes limited by the thermodynamics.

EXAMPLE 4

Table 8 shows the feed and product from a second pilot plant experiment, where sewage sludge derived pyrolysis oil was hydrotreated at 360° C., and used as feedstock in a reactor operating under low severity; i.e. hydrodearomatization conditions. This corresponds to a process similar to FIG. 2, in which all liquid hydrocarbon is transferred from stream 214 to reactor DN2, and shows that shifting the equilibrium away from aromatic nitrogen compounds by removing the NH3 gas after the second reactor and hydrotreating the product from this reactor in a third reactor at higher pressure and lower temperature makes it possible to decrease the N content to 107 wt ppm.

When reviewing Table 7 the extent of different reactions may be estimated, in accordance with the description above. For instance the feedstock contains 4768 $ppm_{wt}$, S which is converted to 381 $ppm_{wt}$ at 340° C. (extent of hydrodesulfidation being 92%) and to 119 $ppm_{wt}$ at 380° C. (extent of hydrodesulfidation 97%).

For comparison the feedstock contains 78900 $ppm_{wt}$, N which is converted to 34350 $ppm_{wt}$ at 340° C. (extent of hydrodenitrication being 57%) and to 5860 $ppm_{wt}$ at 380° C. (extent of hydrodenitrification 94%).

As sulfides are known to be mainly in non-aromatic structures, the hydrodesulfidation is an indication of the catalytically active material being active in hydrotreatment. The moderate extent of hydrodenitrication indicates that the hydrotreatment is insufficient for removal of nitrogen heteroatoms. The ability to remove more nitrogen at elevated temperatures can be seen to be related to a change of the distillation curve from T50 at 363° C. to T90 at 360° C., but the mechanism behind this change is not clear. The total aromatic content is 42 wt % and 41 wt % at 360° C. and 380° C. respectively, and only 38 wt % at 340° C., indicating an increased hydrodearomatization at lower temperature. The total aromatic content of the feedstock is estimated to be around 45-50 wt %, but due to interference with oxygen containing compounds, exact analysis was not possible. To confirm that the catalytically active material at the conditions is active in hydrodearomatization, a similar test with a simplified model compound comprising only hydrocarbons would be carried out.

TABLE 1

| | R1 | R2 |
|---|---|---|
| Condition (a) | 32.30% | 1.40% |
| Condition (b) | 96.90% | 4.83% |

TABLE 2

| | R1 | R2 | R3 | R4 |
|---|---|---|---|---|
| Conditions (a) | 84.33% | 96.17% | 77.60% | 42.81% |
| Conditions (b) | 99.80% | 99.95% | 99.96% | 99.79% |

TABLE 3

| Property | Unit | 102/202/302 |
|---|---|---|
| O | wt % | 7 |
| C | wt % | 74 |
| N | wt % | 8 |
| H | wt % | 11 |
| Boiling point (°C) - ASTM D7500 | | |
| IBP | °C | 80 |
| 10 wt/wt % | °C | 200 |
| 30 wt/wt % | °C | 350 |
| 50 wt/wt % | °C | 400 |
| 70 wt/wt % | °C | 600 |

TABLE 4

| | FIG. 1 | | FIG. 2 | | FIG. 3 | |
|---|---|---|---|---|---|---|
| Stream | Ton/h | N (wt %) | Ton/h | N (wt %) | Ton/h | N (wt %) |
| 112/212/312 | 90 | 7.1 | 90 | 7.1 | 90 | 7.1 |
| 114/214/314 | 86 | 1.9 | 86 | 1.9 | 86 | 1.9 |
| 116 | 85 | 0 | | | | |
| 124/224/324 | 12 | 65 | 10 | 62 | 10.4 | 62 |
| 126/226/326[a] | 17 | 0.0000 | 16 | 0.0010 | 17 | 0.0009 |
| 128/228/328[b] | 47 | 0.0021 | 69 | 2.3 | 47 | 2.0 |
| 130/330[c] | 21.2 | 0.0030 | | | 21 | 3.0 |
| 134/234[d] | 2.0 | 79.5 | 2.0 | 80 | | |
| 136/236[e] | 6.6 | 0.0000 | 0.69 | 0.0 | | |
| 138/238[f] | 13.3 | 0.0000 | 47 | 0.0002 | | |
| 240 | | | 20.8 | 0.0003 | | |
| 244[g] | | | 2.2 | 0.0 | | |
| 246[h] | | | 6.5 | 0 | | |
| 248[i] | | | 13 | 0 | | |
| Naphtha[a+e+h] | 24 | 0.0000 | 24 | 0.0007 | 17 | 0.0009 |
| Diesel[b+f+i] | 60 | 0.0016 | 60 | 0.0002 | 47 | 2.0 |
| Heavies[c] | 0 | 0 | 0 | 0 | 21 | 3.0 |

TABLE 5

| Property | Unit | 102/202/302 |
|---|---|---|
| O | wt % | 2.2 |
| C | wt % | 80.6 |
| N | wt % | 7.9 |
| H | wt % | 9.3 |
| Boiling point (°C) - ASTM D7500 | | |
| IBP | °C | 85 |
| 10 wt/wt % | °C | 173 |
| 30 wt/wt % | °C | 262 |
| 50 wt/wt % | °C | 363 |
| 60 wt/wt % | °C | 445 |

TABLE 6

| | FIG. 1 | | FIG. 2 | | FIG. 3 | |
|---|---|---|---|---|---|---|
| Stream | M kg/h | N (wt %) | M kg/h | N (wt %) | M kg/h | N (wt %) |
| 112/212/312 | 97 | 6.5 | 97 | 6.5 | 97 | 6.5 |
| 114/214/314 | 90 | 0.60 | 90 | 0.60 | 90 | 0.60 |
| 116 | 90 | 0.0302 | | | | |
| 122/222/322 | 2.0 | 0 | 1.6 | 0 | 1.6 | 0 |
| 124/224/324[a] | 12 | 64 | 12 | 63 | 12 | 63 |
| 126/226/326[b] | 18 | 0.0001 | 18 | 0.0024 | 18 | 0.0024 |
| 128/328[c] | 63 | 0.04 | | | 50 | 0.98 |
| 132/228[d] | 9.4 | 0.0000 | 72.2 | 0.75 | | |
| 134/232[e] | 0.9 | 0.31 | 72.3 | 0.011 | | |
| 136/234[f] | 2.8 | 0.0000 | 0.7 | 74 | | |
| 236 | | | 0 | 0 | | |
| 240[g] | | | 11 | 0.0083 | | |
| 242[h] | | | 11.2 | 0 | | |
| 244[i] | | | 1.1 | 0.079 | | |
| Naphtha[a+e+h] | 21 | 0.0001 | 21 | 0.0020 | 18 | 0.0024 |
| Diesel[b+f+i] | 69 | 0.0353 | 68 | 0.0107 | 50 | 0.98 |
| Heavies[c] | 0 | 0 | 0 | 0 | 23 | 0.26 |

TABLE 7

| Condition | Unit | Feed | 1 | 2 | 3 | 4 |
|---|---|---|---|---|---|---|
| Temperature | °C | | 340 | 360 | 380 | 400 |
| Pressure | barg | | 70 | 70 | 70 | 70 |
| LHSV | 1/h | | 0.32 | 0.32 | 0.32 | 0.32 |
| H2/Oil | NI/I | | 4198 | 4199 | 4200 | 4204 |
| SG @ 60/60 °F | | 0.9912 | 0.8958 | 0.874 | 0.8521 | 0.8583 |
| S | wt % | 0.4768 | 0.0381 | 0.0174 | 0.0119 | 0.0536 |
| N | wt ppm | 79400 | 34350 | 20950 | 5114 | 6653 |
| H | wt % | 9.30 | 11.41 | 11.92 | 12.49 | 12.20 |
| O | wt ppm | 22680 | 11960 | 7490 | 5860 | 6830 |
| HDS | % | | 92 | 96 | 97 | 89 |
| HDN | % | | 57 | 74 | 94 | 92 |
| HDO | % | | 47 | 67 | 74 | 70 |
| Mono aromat | wt % | | 20 | 27 | 31 | 30 |
| Di aromat | wt % | | 5.0 | 4.5 | 3.8 | 4.7 |
| Tri+ aromat | wt % | | 13 | 11 | 6.3 | 7.8 |
| Total Aromat | wt % | | 38 | 42 | 41 | 43 |
| Dist Curve IBP | °C | 85 | 105 | 87 | 101 | 102 |
| Dist Curve 5 wt % | °C | 134 | 126 | 113 | 113 | 114 |
| Dist Curve 10 wt % | °C | 173 | 142 | 135 | 131 | 135 |
| Dist Curve 20 wt % | °C | 216 | 176 | 164 | 156 | 161 |
| Dist Curve 30 wt % | °C | 262 | 200 | 194 | 180 | 186 |
| Dist Curve 40 wt % | °C | 308 | 226 | 216 | 204 | 210 |
| Dist Curve 50 wt % | °C | 363 | 251 | 242 | 229 | 234 |
| Dist Curve 60 wt % | °C | 445 | 275 | 267 | 254 | 259 |
| Dist Curve 70 wt % | °C | | 301 | 291 | 281 | 284 |
| Dist Curve 80 wt % | °C | | 339 | 324 | 310 | 310 |
| Dist Curve 90 wt % | °C | | 398 | 380 | 360 | 355 |
| Dist Curve 95 wt % | °C | | 440 | 421 | 401 | 392 |
| Dist Curve FBP | °C | | 560 | 516 | 486 | 471 |

TABLE 8

| Condition | Unit | Feed | 1 | 2 |
|---|---|---|---|---|
| Temperature R1 | °C | | 325 | 335 |
| Pressure | barg | | 151 | 152 |
| LHSV | 1/h | | 0.58 | 0.59 |
| H2/Oil | NI/I | | 2160 | 2123 |
| SG @ 60/60 °F | | 0.8414 | 0.8285 | 0.828 |
| S | wt % | 0.0608 | 0.00015 | 0.00006 |
| N | wt ppm | 4131 | 122 | 98 |
| Mono aromat | wt % | 30 | 24 | 23 |
| Di aromat | wt % | 2.1 | 0.27 | 0.29 |
| Tri+ aromat | wt % | 2.7 | 0.11 | 0.14 |
| Total Aromat | wt % | 35 | 24 | 23 |
| H | wt % | 12.67 | 13.48 | 13.54 |
| O | wt ppm | 7460 | <1000 | <1000 |
| Dist Curve IBP | °C | 101 | 81 | 82 |
| Dist Curve 5 wt % | °C | 112 | 106 | 104 |

TABLE 8-continued

| Condition | Unit | Feed | 1 | 2 |
|---|---|---|---|---|
| Dist Curve 10 wt % | °C | 131 | 126 | 125 |
| Dist Curve 20 wt % | °C | 156 | 151 | 151 |
| Dist Curve 30 wt % | °C | 180 | 175 | 175 |
| Dist Curve 40 wt % | °C | 206 | 199 | 199 |
| Dist Curve 50 wt % | °C | 232 | 226 | 227 |
| Dist Curve 60 wt % | °C | 258 | 254 | 255 |
| Dist Curve 70 wt % | °C | 285 | 280 | 282 |
| Dist Curve 80 wt % | °C | 314 | 311 | 313 |
| Dist Curve 90 wt % | °C | 369 | 362 | 368 |
| Dist Curve 95 wt % | °C | 412 | 409 | 416 |
| Dist Curve FBP | °C | 500 | 503 | 555 |

The invention claimed is:

1. A process for conversion of a feedstock originating from thermal decomposition of solids, containing from at least 0.5 wt % nitrogen and less than 15 wt % nitrogen, and containing at least 0.5 wt % aromatically bound nitrogen, the process comprising the steps of directing the feedstock to contact a material catalytically active in hydrotreatment under active hydrotreatment conditions in the presence of dihydrogen, to provide a hydrotreated intermediate, adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds, directing at least an amount of the hydrotreated intermediate to contact a material catalytically active in hydrodearomatization under said active hydrodearomatization conditions, in the presence of dihydrogen, to provide a further converted intermediate under conditions affecting at least a 10% reduction in the amount of aromatics.

2. The process according to claim 1, in which the adjusting of one or more conditions involves reducing the temperature of the hydrotreated intermediate by at least 25° C.

3. The process according to claim 1, in which the adjusting of one or more conditions involves increasing the pressure by at least 5 MPa and less than 100 MPa.

4. The process according to claim 1, in which the feedstock originates from a thermal decomposition process, in which a material is partially decomposed at elevated temperature, in the presence of substoichiometric amount of oxygen including absence of oxygen.

5. The process according to claim 1, wherein said material catalytically active in hydrodearomatization comprises an active metal taken from the group comprising platinum, palladium, nickel, cobalt, tungsten and molybdenum, and a refractory support.

6. The process according to claim 1, wherein said hydrodearomatization conditions involve a temperature in the interval 200-350° C., a pressure in the interval 3-20 MPa, and a liquid hourly space velocity (LHSV) in the interval 0.5-8.

7. The process according to claim 1, further comprising directing an unstabilized feedstock originating from thermal decomposition of solids, to contact a material catalytically active in hydrotreatment under pretreatment conditions in the presence of dihydrogen, to provide said composition originating from thermal decomposition of solids.

8. The process according to claim 1, further comprising the step of separating the hydrotreated intermediate in at least one fraction not directed to step (b) and a high boiling hydrotreated intermediate, comprising at least 90 wt % material boiling above 150° C., which together with an amount of dihydrogen is directed to step (b).

9. The process according to claim 1, further comprising a step directing at least an amount of the further converted intermediate to contact a material catalytically active in hydrocracking under hydrocracking conditions in the presence of dihydrogen, to provide a hydrocracked intermediate.

10. The process according to claim 1, further comprising the step of separating at least a high boiling further hydrotreated fraction comprising at least 90 wt % material boiling above 250° C., wherein this high boiling further hydrotreated fraction and an amount of dihydrogen is directed to step (d).

11. The process according to claim 9, further comprising the step of separating at least a high boiling further hydrotreated fraction comprising at least 90 wt % material boiling above 450° C., wherein this high boiling further hydrotreated fraction and an amount of dihydrogen is not directed to said step (d).

12. The process according to claim 1, the feedstock containing at least 2 wt % nitrogen and less than 15 wt % nitrogen.

13. A process according to claim 1, in which the adjusting of one or more conditions involves withdrawing an amount of ammonia from the hydrotreated intermediate.

14. The process according to claim 13, wherein withdrawing an amount of ammonia from the hydrotreated intermediate involves addition of wash water and a subsequent flash separation.

15. A process for conversion of a feedstock originating from thermal decomposition of solids, containing from at least 0.5 wt % nitrogen and less than 15 wt % nitrogen, comprising the steps of directing the feedstock to contact a material catalytically active in hydrotreatment under active hydrotreatment conditions in the presence of dihydrogen, to provide a hydrotreated intermediate, adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds, directing at least an amount of the hydrotreated intermediate to contact a material catalytically active in hydrodearomatization under said active hydrodearomatization conditions, in the presence of dihydrogen, to provide a further converted intermediate, in which the adjusting of one or more conditions involves withdrawing an amount of ammonia from the hydrotreated intermediate.

16. The process according to claim 15, wherein withdrawing an amount of ammonia from the hydrotreated intermediate involves addition of wash water and a subsequent flash separation.

17. A process for conversion of a hydrocarbonaceous feedstock containing from at least 0.5 wt % nitrogen to less than 15 wt % nitrogen and containing at least 0.5 wt % aromatically bound nitrogen, and containing at least 0.5 wt % aromatically bound nitrogen, comprising the steps of directing the feedstock in combination with an amount of di-hydrogen to contact a first catalytically active material comprising at least one of molybdenum and tungsten, optionally in combination with nickel or cobalt on a refractory support comprising silica, titania or alumina at a temperature in the interval 250-400° C., a pressure in the interval 3-15 MPa, a gas to oil ratio of 200-2000 $Nm^3/m^3$ and a liquid hourly space velocity (LHSV) in the interval 0.1-2, to produce a product stream comprising a hydrocarbonaceous liquid with a reduced content of nitrogen and an amount of ammonia, adjusting one or more conditions of the hydrotreated intermediate stream to active hydrodearomatization conditions where the equilibrium between aromatic nitrogen compounds and non-aromatic nitrogen-free compounds is shifted towards non-aromatic nitrogen-free compounds, directing at least an amount of the hydrotreated intermediate to contact a second catalytically active material after active adjustment of at least one process condition relative to step (i) such that the equilibrium between aromatic nitrogen compounds and non-aromatic nitrogen-free compounds shifted towards non-aromatic nitrogen-free compounds.

18. The process according to claim 17, the feedstock containing at least 2 wt % nitrogen and less than 15 wt % nitrogen.

19. A pyrolysis oil conversion plant, comprising a first reactor containing a material catalytically active in hydrotreatment, and a second reactor containing a material catalytically active in hydrodearomatization, wherein said second reactor is configured for receiving the outlet from the first reactor, and the pyrolysis oil conversion plant is configured for reducing the inlet temperature to the second reactor, for increasing the pressure before the second reactor or for washing the outlet from the first reactor with an amount of water.

20. A pyrolysis plant, comprising a pyrolizer, and the pyrolysis conversion plant according to claim 19, wherein the pyrolizer is configured to provide a pyrolysis oil feedstock to the first reactor.

* * * * *